US006349862B1

(12) United States Patent
Smith et al.

(10) Patent No.: US 6,349,862 B1
(45) Date of Patent: Feb. 26, 2002

(54) FOLDING HANGER FOR HATS

(76) Inventors: J. L. Smith, 2325 Marshall Rd., Waxahachie, TX (US) 75167; Klint Owens, 7839 Hwy. 377, Pilot Point, TX (US) 76258

( * ) Notice: Subject to any disclaimer, the term of this patent is extended or adjusted under 35 U.S.C. 154(b) by 0 days.

(21) Appl. No.: 09/645,841

(22) Filed: Aug. 25, 2000

(51) Int. Cl.[7] ..... A47G 25/14
(52) U.S. Cl. ..... 223/85; 223/24; 223/25
(58) Field of Search ..... 223/24, 84, 85, 223/25, 89, 94; 211/30, 32, 33

(56) References Cited

U.S. PATENT DOCUMENTS 2,574,557 A * 11/1951 Goodhand ..... 223/24
2,630,921 A * 3/1953 Stephenson ..... 223/85
2,640,594 A * 6/1953 Lesikar ..... 223/24
3,036,698 A * 5/1962 Gronemeyer ..... 223/24
3,083,884 A * 4/1963 Seigal ..... 223/25
5,033,660 A 7/1991 Kelly ..... 211/30
5,169,007 A 12/1992 McHendry ..... 211/30
5,826,759 A * 10/1998 Ohsugi ..... 223/85
6,116,481 A * 9/2000 Arnold ..... 223/24

* cited by examiner

*Primary Examiner*—Bibhu Mohanty

(57) ABSTRACT

A folding hanger for hats comprised of a hook detail, suspending a foldable support, on which vertically depends an oval shaped flat ring. The hook detail, foldable support, and ring are molded of plastic, in a generally flat form. The hook detail and foldable support are attached to the oval shaped flat ring, and folded into a generally box-shaped structure by a user. This foldable box-shaped support provides protection for a brim of a hat, and suspends the oval shaped flat ring. The ring is inserted into the crown of a hat, and retains the hat by maintaining outwardly tensile pressure, throughout circumference of inside of the crown, thereby retaining, and protecting its shape.

1 Claim, 2 Drawing Sheets

FOLDING HANGER FOR HATS

CROSS REFERENCE TO RELATED APPLICATIONS

Not applicable

BACKGROUND—FIELD OF INVENTION

The invention relates to the suspension, support, preservation, and storage, of a hat that is specifically designed to maintain its shape, such as a western style felt or straw hat, or a fashion hat with adornments attached around the crown or brim.

BACKGROUND—DESCRIPTION OF PRIOR ART

Prior Art references, such as the "HAT HANGER" U.S. Pat. No. 5,169,007 for McHendry and the "WIRE HANGER TO HOLD HATS" U.S. Pat. No. 5,033,660 for Kelly will by design and application, damage or alter the shape of a hat, by suspending the hat from a single point inside the crown. In addition the prior designs employ the use of cylindrical materials, thereby applying damaging pressure to a shape-able portion of the hat.

No prior art has been found relating to a folding hat hanger, which is manufactured, transported, and merchandised, in a flat form, or on a flat card, for the purposes of marketing, which is folded into a functional form by the end user.

SUMMARY

The invention is a molded plastic, folding, hanger for a hat, manufactured and marketed in a generally flat form, which when folded into its functional form, suspends, and retains a hat, on an adjustable, flat, oval shaped ring, inserted into the inside of the crown of the hat.

OBJECTS AND ADVANTAGES

The invention will provide support, and protection of a shape-able hat, by means of an adjustable, flat, oval shaped ring, which is inserted into the crown of a hat, and maintained at the base of the crown.

This ring maintains constant contact throughout the circumference of the base of the crown, in exactly the same manner as a human head.

As shape-able hats are designed to be self conforming to a human head, the oval shaped ring is designed to maintain light, outwardly tensile pressure, and conform to the shape of the crown of the hat.

The oval shaped ring is suspended from a folding hanger body, generally shaped as a three sided box, which provides protection for the brim or bill of the hat. The three sided box structure, will provide support and protection from external pressures on the brim of the hat.

In addition the hanger body and oval shaped ring, are molded of plastic in a generally flat form. The hanger body incorporates a series of hinges and locking details, whereby it is folded and locked into its functional form.

The manufacture, transport, and merchandising of the invention, in its flat form, will reduce: Manufacturing costs, by reducing the size of the mold and machine capacity required; Transportation costs, by reducing the cube size of the finished product; Merchandising and display cost, by reducing the amount of area required to display the product.

LIST OF REFERENCE NUMERALS

1 Hook
2 Hanger Body
3 Flat Ovular Ring
4 Hook Hinge
5 Upper Hanger Body Hinge
6 Lower Hanger Body Hinge
7 Upper Hanger Body
8 Center Hanger Body
9 Lower Hanger Body
10*a* Hook Hinge Locking Detail (A)
10*b* Hook Hinge Locking Detail (B)
11*a* Upper Hanger Body Locking Detail (A)
11*b* Upper Hanger Body Locking Detail (B)
12*a* Lower Hanger Body Locking Detail (A)
12*b* Lower Hanger Body Locking Detail (B)
13*a* Ovular Ring Support (A)
13*b* Ovular Ring Support (B)
14*a* Ovular Ring Support Locking Detail (A)
14*b* Ovular Ring Support Locking Detail (B)
15*a* Ovular Ring Connecting Sleeve (A)
15*b* Ovular Ring Connecting Sleeve (B)
16 Ovular Ring Closure Detail
17 Ovular Ring Tensioner Tab
18 Ovular Ring Adjustment Tab
19 Ovular Ring De-Tensioner Tab
20 Closure Sleeve
21 Adjustment Locking Detail
22 Adjustment Locking Receptacle

DESCRIPTION OF THE MAIN EMBODIMENT

Figure 1:
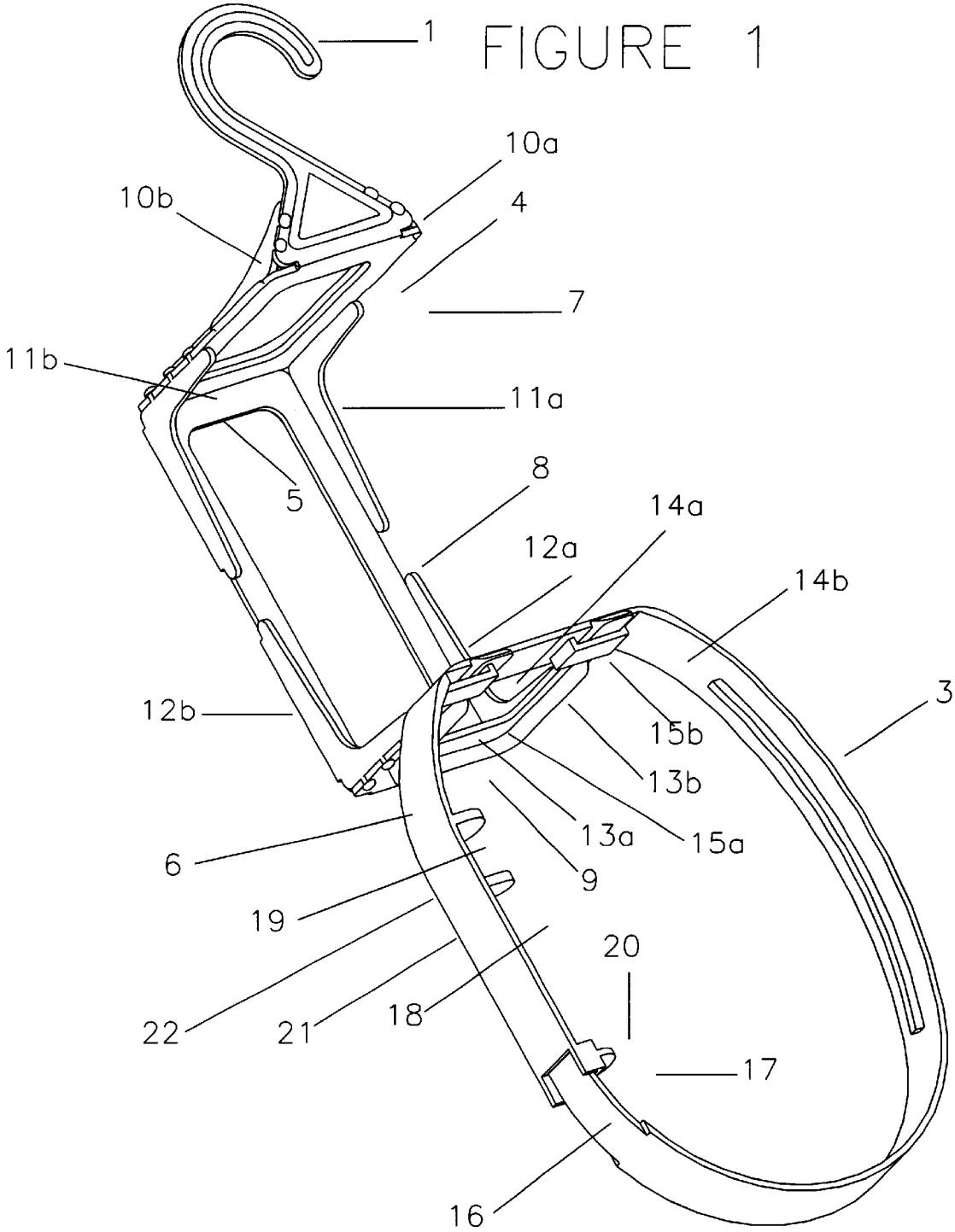
FIG. 1 is a perspective view of the present invention, in which the FLAT OVULAR RING has been attached to the HANGER BODY, and the HANGER BODY has been folded and locked into its functional form.
Figure 2:
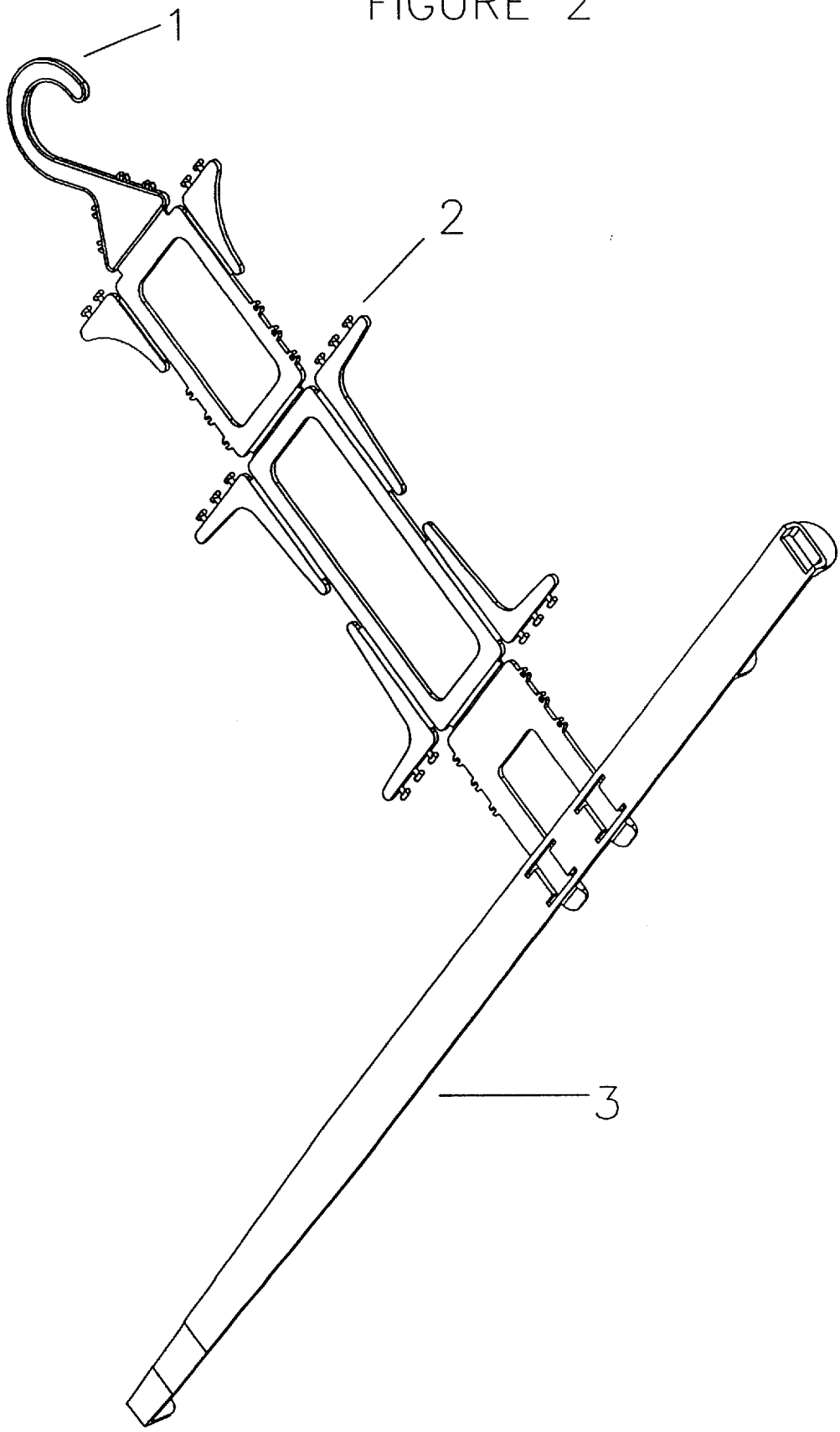
FIG. 2 is a perspective view of the present invention, in flat form, with the FLAT OVULAR RING attached to the HANGER BODY.

FIG. 1 depicts the invention FOLDING HANGER FOR HATS in it's functional form, beginning with a vertically positioned hanging device or HOOK 1 extending downwardly and terminating in a HOOK HINGE DETAIL 4. Said HOOK HINGE DETAIL 4 rotates at or about 90 degrees rearward and terminates in an UPPER HANGER BODY 7. Said UPPER HANGER BODY 7 is suspended horizontally, and rearwardly by said HOOK HINGE DETAIL 4 and locked at or about 90 degrees by HOOK HINGE LOCKING DETAILS 10*a* and 10*b*. Said UPPER HANGER BODY 7 terminates in an UPPER HANGER BODY HINGE 5 which rotates at or about 90 degrees downwardly and terminates in a CENTER HANGER BODY 8. Said CENTER HANGER BODY 8 is suspended downwardly and vertically by said UPPER HANGER BODY HINGE 5 and locked at or about 90 degrees by two UPPER HANGER BODY LOCKING DETAILS 11*a* and 11*b*, and terminates in a LOWER HANGER BODY HINGE 6. said LOWER HANGER BODY HINGE 6 rotates at or about 90 degrees forward and terminates in a LOWER HANGER BODY 9. Said LOWER HANGER BODY 9 is suspended forwardly and horizontally by said LOWER HANGER BODY HINGE 6, and locked at or about 90 degrees horizontally by two LOWER HANGER BODY DETAILS 12*a* and 12*b*. The LOWER HANGER BODY 9 terminates in two forwardly extending OVULAR RING SUPPORTS 13*a* and 13*b*. Said OVULAR RING SUPPORTS 13*a* and 13*b* terminate in the two OVULAR RING SUPPORT LOCKING DETAILS 14*a* and 14*b*. Said OVULAR RING SUPPORTS 13*a* and 13*b* are inserted into the two OVULAR RING CONNECTING SLEEVES 15*a* and 15*b* and locked by means of two said OVULAR RING SUPPORT LOCKING DETAILS 14*a* and 14*b*.

The FLAT OVULAR RING 3 is closed and made ovular, by downwardly rotating an OVULAR RING CLOSURE DETAIL 16 and a CLOSURE SLEEVE 20 and inserting said OVULAR RING CLOSURE DETAIL 16 through said CLOSURE SLEEVE 20.

Once said FLAT OVULAR RING 3 is closed in the aforementioned manner, the circumference of said FLAT OVULAR RING 3 is reduced by compressing towards each other an OVULAR RING ADJUSTMENT TAB 18 and an OVULAR RING DE-TENSIONER TAB 19. The circumference of said FLAT OVULAR RING 3 is increased by compressing toward each other said OVULAR RING ADJUSTMENT TAB 18 and an OVULAR RING TENSIONER TAB 17. The circumference of said FLAT OVULAR RING 3 is maintained by the constant tensile pressure of an ADJUSTMENT LOCKING DETAIL 21 on the ribbed surface of an ADJUSTMENT LOCKING RECEPTACLE 22.

Operation of Main Embodiment

The use of the invention FOLDING HANGER FOR HATS is for the suspension, support, and protection of a shaped or shape-able hat, by means of a folding plastic hanger. Additionally the use of the invention is the manufacture of said hanger in a generally flat form, for the purposes of lower manufacturing costs, package-ability, merchandisability, and transportability.

A user upon receipt of said invention, generally merchandised on, but not limited to, a flat card or in a flat form, will fold the hanger body by use of its hinges and locking details, into its usable form. The user will attach and close said flat ovular ring and insert it into the base of the crown of a hat, thereby securing said hat to said hanger.

Description and Operation of Alternative Embodiments

The foregoing description and operation of the main embodiment, may be altered by those skilled in the art, by means of, but not limited to; the use of alternate type hinges and locking details, than those described in the main embodiment, the use of polymers, vinyl resins, or synthetic resins, in the construction of the invention, the use of a modified oval shaped ring detail which may be inserted into the crown of a hat. Said alterations or modifications are considered to be within the scope and purview of the present invention, as defined by the following claims.

What is claimed is:

1. A hanger for a hat comprising a hook having a folding hinge which allows the hook to be collapsed, the hook being attached to a central body member, the central body member being hingedly attached to a flat ring that is generally oval shaped and which is adjustable in size to conform to the interior shape of different sized hats, the flat oval shaped ring including a locking mechanism to lock the ring to a desired size to support and shape the hat.

* * * * *